US005813495A

United States Patent [19]

Smith

[11] Patent Number: 5,813,495

[45] Date of Patent: Sep. 29, 1998

[54] COLLAPSIBLE SAWHORSE WITH HINGED LEGS

[76] Inventor: Kevin Smith, 419 Shepp Ct., Santa Rosa, Calif. 95407

[21] Appl. No.: 855,493

[22] Filed: May 13, 1997

[51] Int. Cl.[6] ..... E04G 1/34

[52] U.S. Cl. ..... 182/155; 182/186.2; 182/186.3

[58] Field of Search ..... 182/155, 153, 182/186.1, 186.2, 186.3, 226

[56] References Cited

U.S. PATENT DOCUMENTS

| | | | |
|---|---|---|---|
| 1,960,991 | 5/1934 | De Young | 182/155 |
| 2,412,716 | 12/1946 | Campbell . | |
| 2,673,765 | 3/1954 | Storck | 182/155 |
| 2,706,661 | 4/1955 | Clayton . | |
| 3,162,266 | 12/1964 | Franzen | 182/155 |
| 3,282,379 | 11/1966 | Jones | 182/155 |

FOREIGN PATENT DOCUMENTS

| | | | |
|---|---|---|---|
| 247639 | 3/1947 | Switzerland | 182/155 |

*Primary Examiner*—Alvin C. Chin-Shue
*Attorney, Agent, or Firm*—Jack Lo

[57] ABSTRACT

A collapsible sawhorse includes an elongated board with a pair of support legs at each end. Each leg is connected to the bottom of the board by a transverse hinge and a longitudinal hinge. The hinges enable the legs to be first folded inwardly, and then upwardly against the bottom of the board.

1 Claim, 1 Drawing Sheet

COLLAPSIBLE SAWHORSE WITH HINGED LEGS

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to sawhorses.

2. Prior Art

A typical sawhorse includes an elongated board with a pair of legs at each end. Two sawhorses are usually used for elevating a piece of lumber above the ground for cutting. However, such sawhorses are not collapsible, so that they are inconvenient to transport and store.

OBJECTS OF THE INVENTION

Accordingly the primary object of the present invention is to provide a sawhorse which is collapsible for convenient transportation and storage.

Further objects of the present invention will become apparent from a consideration of the drawings and ensuing description.

BRIEF SUMMARY OF THE INVENTION

A collapsible sawhorse includes an elongated horizontal board with a pair of legs at each end. The legs in each pair are hinged to fold inwardly toward each other, and they are further hinged to fold upwardly against the bottom of the board.

DRAWING REFERENCE NUMERALS

10. Board
11. Hinge
12. Movable Tab
13. Fixed Tab
14. Joint
15. Legs
16. Hinge
17. Side Edge
18. Side Edge
19. Backing Plate
20. L-Shaped Bracket
21. Strap
22. Folding Connecting Arm
23. Stop

DETAILED DESCRIPTION OF THE INVENTION

Figure 1:
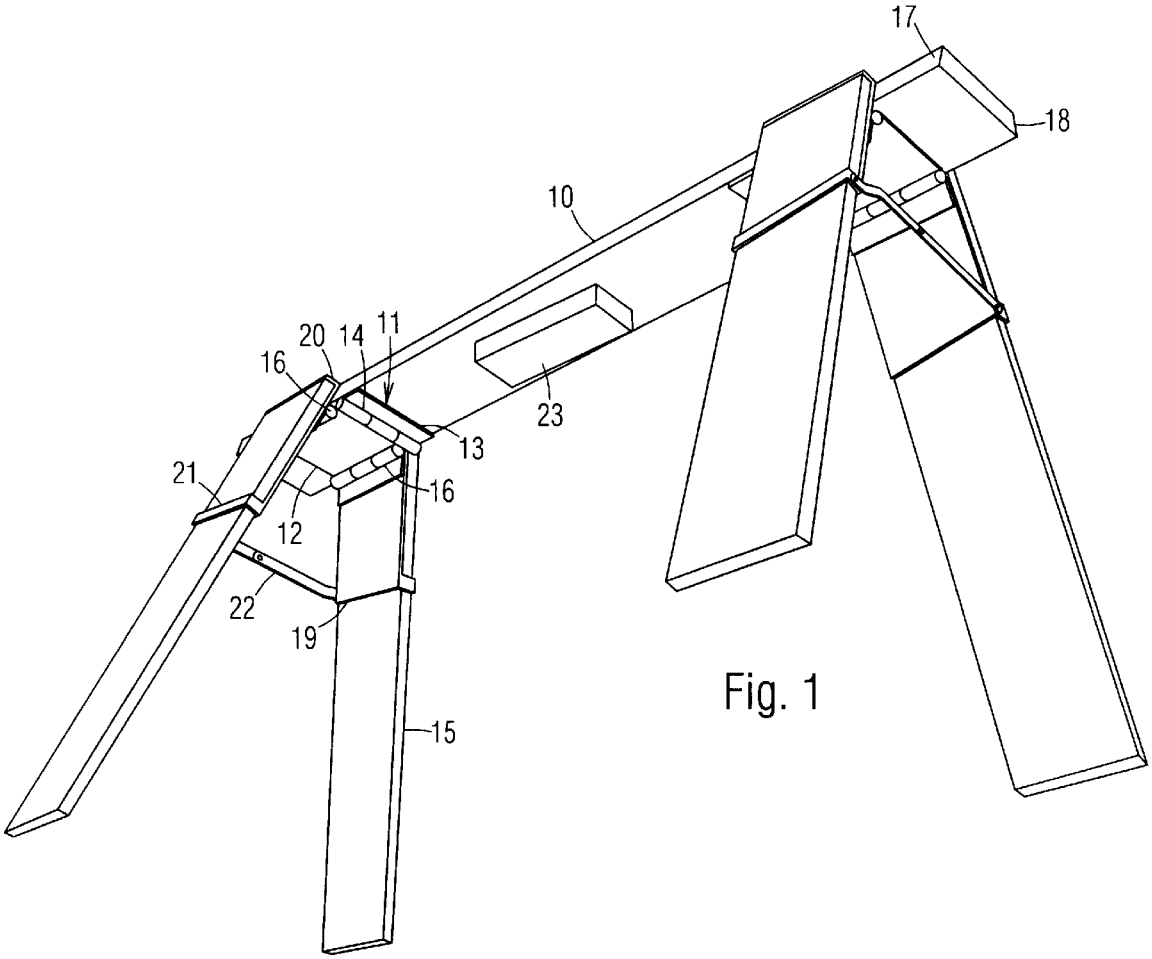
FIG. 1 is a bottom view of a collapsible sawhorse in an extended position.

In accordance with a preferred embodiment of the invention shown in the bottom perspective view of FIG. 1, a collapsible sawhorse includes an elongated horizontal board 10, and a pair of transverse hinges 11 extending transversely across the bottom of board 10 adjacent opposite ends thereof. Each hinge 11 includes a fixed tab 13 fixedly attached to board 10, and a movable tab 12 rotatable about a pivoting joint 14. A pair of legs 15 are pivotally connected to opposite sides of each movable tab 12 by a pair of longitudinal hinges 16. When in an extended position as shown, legs 15 are each generally orthogonal to board 10.

The upper end of each leg 15 extend above hinge 16 so that it is flush with the top surface of board 10. Opposite side edges 17 and 18 of board 10 are beveled so that when legs 15 are opened, they are spread outwardly to provide a wide, stable stance. The inner side of the upper end of each leg 15 is reinforced by a metal or plastic backing plate 19. The upper end of backing plate 19 includes a L-shaped bracket 20 which is wrapped around the tip of leg 15, and the lower end of backing plate 19 includes a strap 21 wrapped around the outer side of leg 15. Each pair of legs 15 is connected by a folding connecting arm 22 for limiting spread. The sawhorse is shown in an extended position, ready for use. A stop 23 is attached to the bottom of board 10 for engaging legs 15 when they are collapsed.

Figure 2:
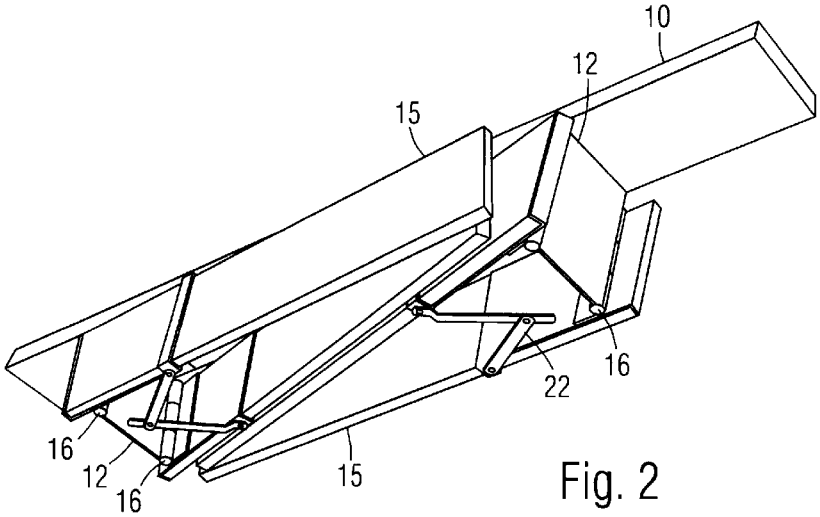
FIG. 2 is a bottom view of the sawhorse in a collapsed position.

Hinges 16 enable each pair of legs 15 to be first folded inwardly toward each other in opposite directions transverse to board 10. Hinges 11 enable the pairs of legs 15 to be folded upwardly against the bottom of board 10 and thus parallel thereto. The sawhorse is shown in a collapsed position in FIG. 2. The folded legs 15 are engaged against stop 23, and a strap (not shown) may be wrapped around legs 15 to secure them in the collapsed position.

SUMMARY AND SCOPE

Accordingly, I have provided a sawhorse which is collapsible for convenient transportation and storage.

Although the above descriptions are specific, they should not be considered as limitations on the scope of the invention, but only as examples of the embodiments. Many substitutes and variations are possible within the teachings of the invention. For example, an additional strap may be provided on the backing plate for securing the top end of the leg. The backing plates may be eliminated, and the hinges may be attached directly to the legs. Other types of hinges may be used. The legs may be attached with either the longitudinal hinge or the transverse hinge for folding in one direction only. Therefore, the scope of the invention should be determined by the appended claims and their legal equivalents, not by the examples given.

I claim:

1. A collapsible sawhorse, comprising:

a elongated horizontal board with opposite longitudinal beveled side edges continuously extending between opposite ends, said beveled side edges are tapered in an upwardly direction; and a plurality of backing plates each having an inner side hinged to said board by a longitudinal hinge and a transverse hinge, said longitudinal hinge having a longitudinal rotational axis extending between said opposite ends of said board, said transverse hinge having a transverse rotational axis extending between said side edges of said board, said backing plates each including a strap with opposite ends fastened to opposite side edges thereof at a lower end and a L-shaped bracket at a top end; and a plurality of legs each positioned through said strap of a corresponding backing plate and having an upper end abutting a corresponding L-shaped bracket, each of said legs having an extended position generally orthogonal to said board, and is foldable about said longitudinal axis and said transverse axis to a collapsed position generally parallel to said board, said inner side of each of said backing plates engaging flat against a corresponding one of said beveled side edges of said horizontal board when said legs are in said extended position, so that said legs are outwardly spread.

* * * * *